US006431627B1

(12) United States Patent
Tomeny

(10) Patent No.: US 6,431,627 B1
(45) Date of Patent: Aug. 13, 2002

(54) CARRIER FOR HOCKEY STICKS

(76) Inventor: Steven A. Tomeny, 4605 Wilcox Pl., Jamesville, NY (US) 13078

( * ) Notice: Subject to any disclaimer, the term of this patent is extended or adjusted under 35 U.S.C. 154(b) by 0 days.

(21) Appl. No.: 09/906,427

(22) Filed: Jul. 16, 2001

(51) Int. Cl.[7] ..... B65D 71/00

(52) U.S. Cl. ..... 294/163; 211/60.1; 211/70.2; 294/161

(58) Field of Search ..... 294/143, 146, 294/147, 159, 161–163, 169, 165; 43/21.2; 206/315.1, 315.2; 211/60.1, 70.2, 70.5, 70.6, 70.8, 125; 224/917, 922

(56) References Cited

U.S. PATENT DOCUMENTS

| | | | | | |
|---|---|---|---|---|---|
| 839,298 | A | | 12/1906 | Kitterman et al. | |
| 1,678,353 | A | * | 7/1928 | Reach | 294/163 X |
| 1,835,632 | A | | 9/1930 | Buhrke | |
| 1,987,159 | A | | 4/1934 | Rasmussen | |
| 2,243,387 | A | * | 5/1941 | Livingston | 294/161 X |
| 3,215,181 | A | | 7/1962 | Reed | |
| 3,262,619 | A | | 4/1965 | Selnes | |
| 3,370,696 | A | * | 2/1968 | Groe | 294/161 |
| 3,483,996 | A | * | 12/1969 | Scammon | 294/147 |
| 3,880,336 | A | | 4/1975 | Demasson | |
| 4,014,466 | A | | 3/1977 | Wess et al. | |
| 4,479,674 | A | * | 10/1984 | Nordmeyer | 294/163 X |
| 4,500,128 | A | * | 2/1985 | Mc Clure | 294/163 X |
| 4,779,914 | A | | 10/1988 | Friedline | |
| 5,954,379 | A | * | 9/1999 | Pikel | 294/159 |

* cited by examiner

*Primary Examiner*—Johnny D. Cherry
(74) *Attorney, Agent, or Firm*—Wall Marjama & Bilinski LLP

(57) ABSTRACT

The invention relates to the design of a hockey stick carrier. The main frame of the the carrier is shaped like an inverted U and is made from light weight, tubular material. The two vertical legs of the inverted U-shaped frame each contain a series of vertically spaced dowel pins extending outwardly on the front and rear sides of the legs. The dowel pins on each of the two vertical legs are positioned such that correspondingly designated dowel pins on either the front or the rear side of the two vertical legs are horizontally aligned with respect to each other. Four locking bars, one each to the front and rear side of each of the two vertical legs, are hinged to the frame. To the front and rear of the bottom of each vertical leg is attached a spring latch, one corresponding to each of the locking bars. Each of the four locking bars can be independently closed and latched so that it encloses the space between the dowels or pins, the frame and the locking bar. The hockey sticks that are laid in between the correspondingly aligned pairs of dowel pins on the two vertical legs are secured in place when the locking bar is latched to the spring latch. The cross beam also serves a full length handle.

7 Claims, 3 Drawing Sheets

CARRIER FOR HOCKEY STICKS

FIELD OF THE INVENTION

This invention relates generally to racks for carrying and storing hockey sticks-in an orderly manner. However, the rack can be easily adapted to carrying any other type of sports equipment.

BACKGROUND OF THE INVENTION

Various types of carrying devices for carrying hockey sticks and other similar sporting equipment are known in the prior art. For example, U.S. Pat. No. 3,880,336 issued to Demasson discloses a hockey stick carrier for stacking and carrying multiple pairs of hockey sticks. This carrier design allows the stacking of a number of pairs of hockey sticks and clamping them together in a bundle for ease of carrying. However, this carrier design does not allow proper display of hockey sticks or for the removal of a particular hockey stick buried in the bundle without dismantling the entire bundle.

U.S. Pat. No. 3,215,181 to Reed discloses a golf club caddy having a pair of substantially rectangular, tubular frame members that are held in longitudinal parallel alignment by spaced apart spring clips that are secured to the frame members by screws. The spring clips are arranged in vertically spaced, horizontally, or longitudinally aligned pairs in which the clubs are removably held in a horizontal position. The clubs, however, can be easily dislodged from the clips, particularly as the clips age.

U.S. Pat. No. 4,014,466 to Wess et al discloses a carrying frame for fishing poles. The carrying frame includes a rectangular member which includes vertically spaced upper and lower elongated horizontal legs and opposite upstanding elongated vertical legs. Corresponding portions of the vertical legs are provided with spaced pairs of clamps for releasably engaging portions of fishing poles. The upper horizontal leg has a centrally located handle supported thereon. The frame may be disassembled and stored in a compact state. Only one side of the frame is provided with clamps and the carrying capacity of the device is thus limited.

U.S. Pat. No. 4,779,914 to Friedline describes a rack for carrying and displaying fishing equipment, such as fishing rods. The rack comprises two hinged frame sections adapted for holding fishing rods. Hinges are located along their top edges of the two frame members so that the rack can be opened into a free standing A-shaped structure. Notches are provided in the frame members which contain a foam-like material. Fishing rods are inserted into the notches so that the foam holds the fishing rods in place. Here again, the poles can be easily dislodged from the foam material and the foam can lose its holding ability as it ages or if it is exposed to moisture over a period of time.

SUMMARY OF THE INVENTION

An object of the present invention is to improve racks for organizing, carrying and storing a number of hockey sticks.

Another object of the present invention is to provide a simple carrier for hockey sticks that has a closure device for preventing the hockey sticks from being inadvertently dislodged from the carrier.

Still another object of the present invention is to provide a hockey rack from which one or more individual hockey sticks can be easily removed without disturbing the remaining hockey sticks.

A further object of the present invention is to provide a carrying rack which can accommodate a maximum number of hockey sticks in a minimum amount of space.

Yet another objective of the present invention is to provide a carrying rack with an elongated horizontally disposed handle that allows for a balanced hold on the rack as its center of gravity shifts as sticks are added or removed from the rack.

These and other objects of the invention can be attained by a rack for carrying and storing hockey sticks that has a symmetrical arrangement of parts. Briefly, the carrier has a plurality of horizontally aligned dowel pins tightly press-fitted through the vertical legs of an inverted U-frame structure. The dowel pin extension on either side of each vertical leg is being enclosed by a symmetrical arrangement of four locking bars which are held in the locked position with the help of spring locks. The carrier of the current invention thus allows one to organize and arrange a plurality of hockey sticks in a very orderly manner in a very limited space, while permitting removal of any number of sticks without affecting any of the remaining hockey sticks in the carrier. The carrier has an elongated handle that allows the user to easily find the center of gravity of the carrier when an unbalanced load is contained in the carrier.

BRIEF DESCRIPTION OF THE DRAWINGS

For a further understanding of these and objects of the invention, reference will be made to the following detailed description of the invention which is to be read in connection with the accompanying drawing, wherein.

DETAILED DESCRIPTION OF THE INVENTION

Figure 1:
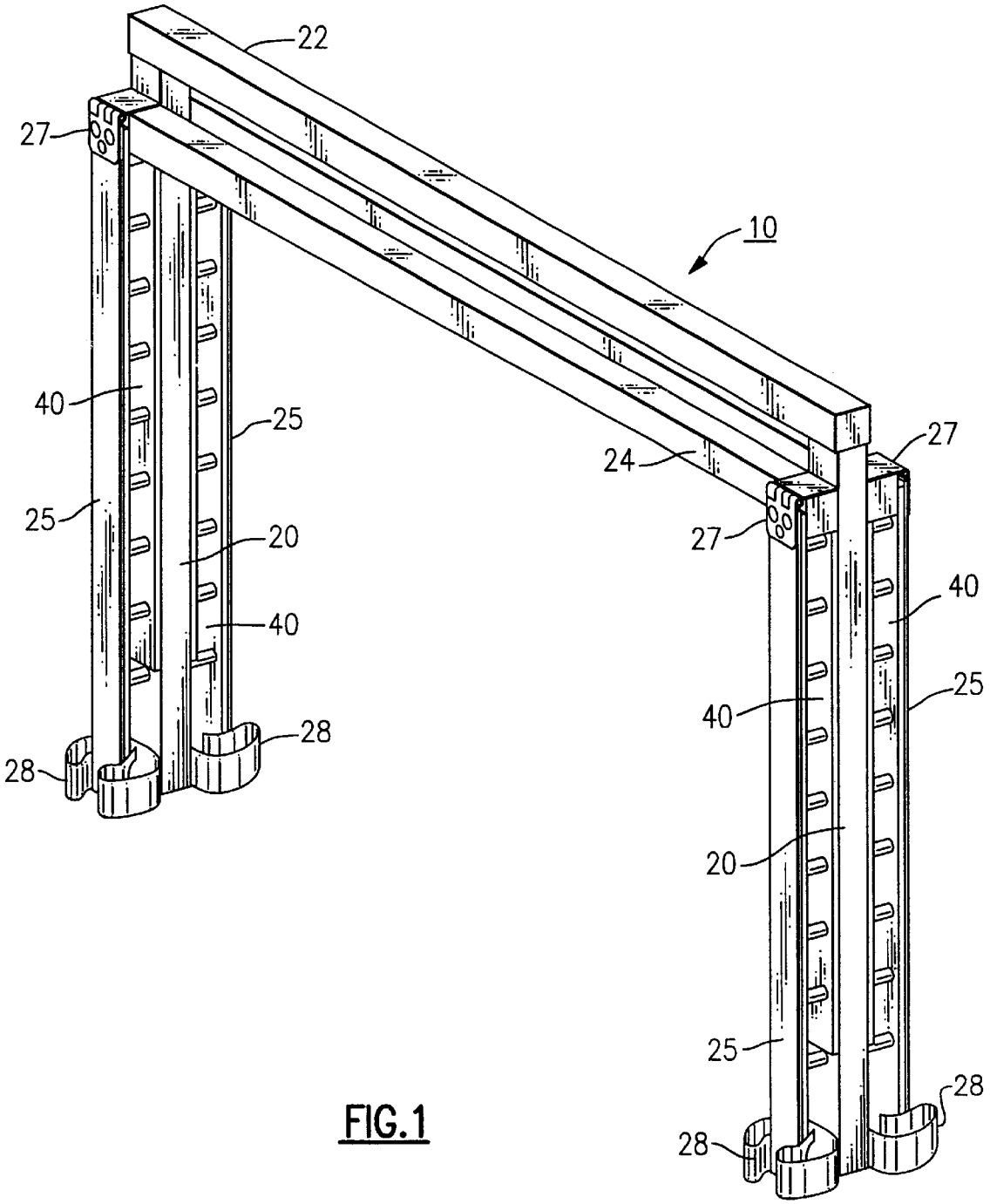
FIG. 1 is a perspective view illustrating a rack for carrying and storing hockey sticks which embodies the teachings of the present invention.
Figure 2:
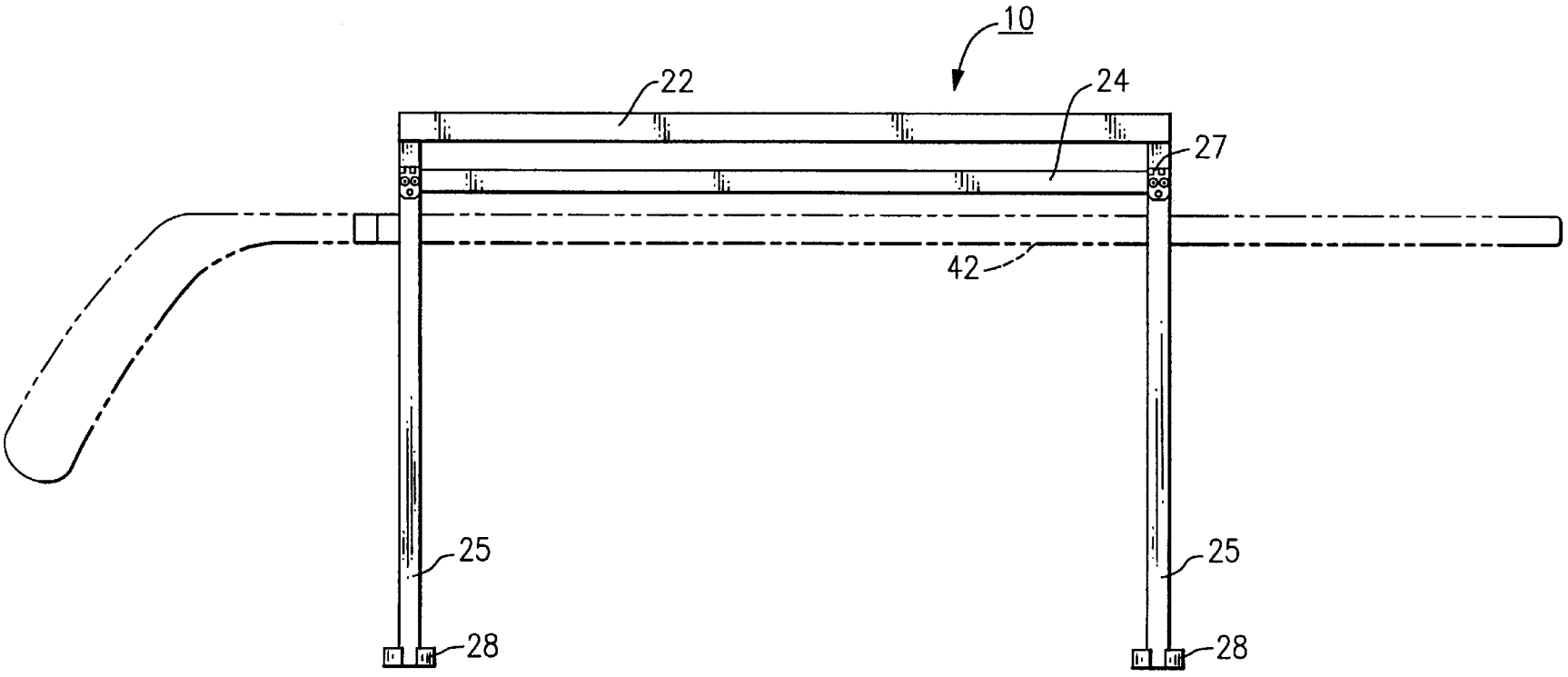
FIG. 2 is a front elevation of the rack shown in FIG. 1 illustrating a hockey stick mounted therein.

Referring now to the drawings, there is illustrated a rack, generally referenced 10, for carrying and storing hockey sticks in an orderly manner which embodies the teachings of the present invention. The main element of the hockey carrier comprises an inverted U-shaped frame 11 made from light weight, tubular members. The frame is preferably fabricated of square or rectangular shaped aluminum tubes as shown in FIGS. 1 and 2. The inverted U-frame structure comprises two vertical legs 20 secured by any suitable means to a horizontal cross beam 22. The horizontal cross beam that is firmly secured to the vertical legs 20, also serves as a full length handle for the carrying rack.

Somewhat removed from the cross beam of the inverted U-shaped frame are two horizontal, rectangular or square cross rails 24—24 that are secured by any suitable means to each side of the vertical legs of the frame. The two horizontal cross rails are symmetrically disposed in parallel alignment as illustrated in the drawings. Such symmetrical placement of the two horizontal cross rails 24 relative to the two vertical legs 20 provides strength and balance to the carrying rack structure.

Attached to the cross rails 24 are a series of locking bars 25. The locking bars are secured to the cross rails by hinge 27. There are four symmetrically positioned hinges mounted on the outer ends of the rails so that the locking bars can hang down in parallel alignment on either side of the vertical legs 20—20. A pair of spring latching mechanisms 28 are secured to the bottom of each vertical leg 20 so that the mechanisms face outwardly from either side of the frame. In assembly, the locking bars can be captured within the latching mechanisms as illustrated in FIG. 1 so that a uniform space is provided between the bars and the vertical legs along the length of the bars.

A series of spaced apart dowels 32 are press-fitted into the front side and back side walls of the vertical legs. Each dowel has an axial length such that the dowels, in assembly, extend outwardly an equal distance to either side of the containing vertical legs, the distance being equal to or slightly less than the width of the two overlying parallel rails. Accordingly, when the locking bars are placed in a latched position as illustrated in FIG. 1, the dowels and locking bars form a series of vertically disposed compartments 40 on either side of the vertical legs. The dowels mounted on each vertical leg are in horizontal alignment with those mounted on the opposite leg so that the shaft of a hockey stick can be placed in corresponding compartments thus supporting the stick in a horizontal posture as illustrated by the stick 42 in FIG. 2.

Figure 3:
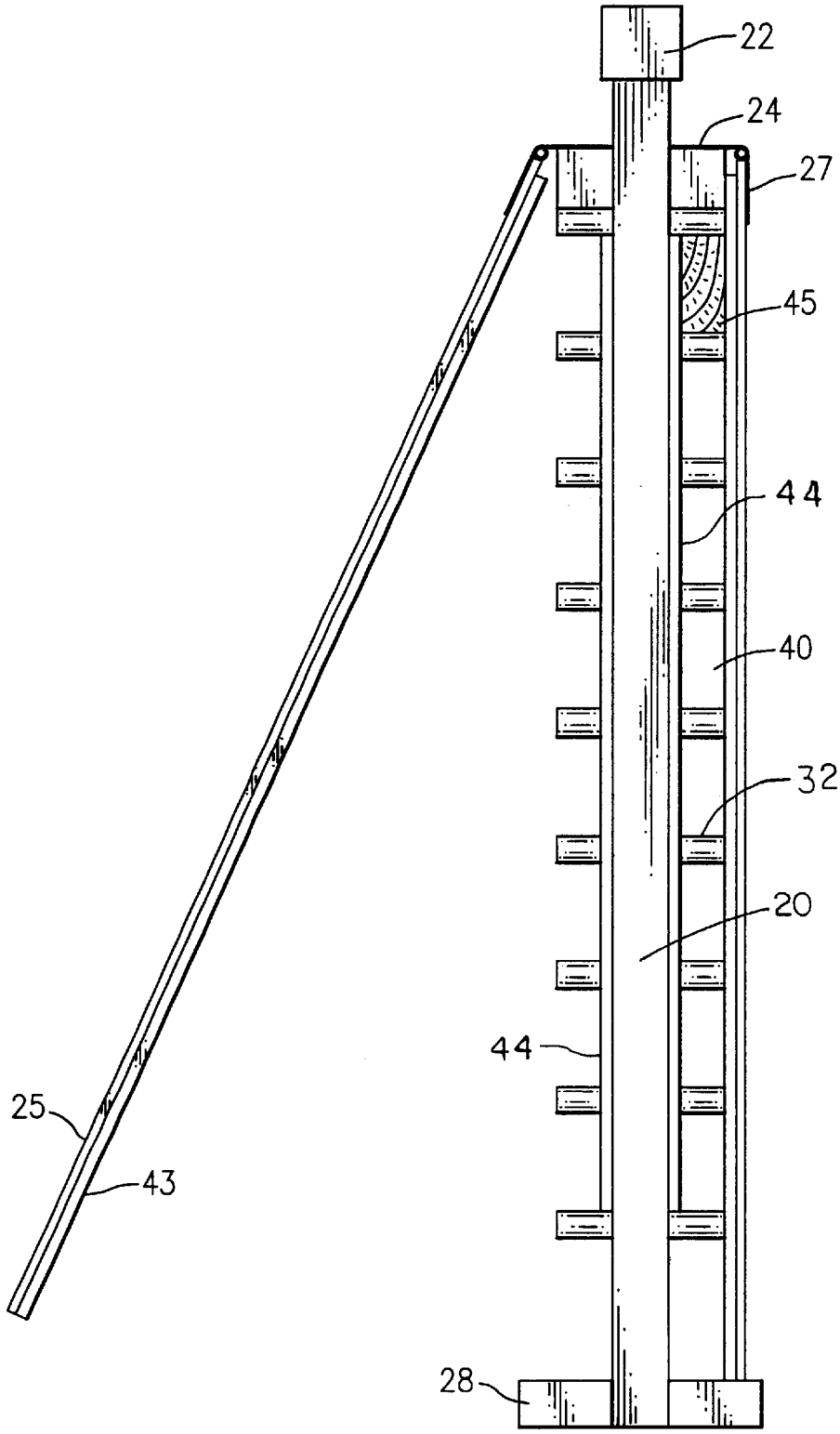
FIG. 3 is an end view of the rack showing one locking bar situated on one side of the rack in an open position and the other locking bars in the closed position.

As best illustrated in FIG. 3, the inner surface of each locking bar 25 is provided with a resilient strip of material 43. The front and back side walls of the vertical legs may be similarly equipped with strips 44—44. The cross sectional dimensions of each compartment are arranged so that they are about the same as those of an average hockey stick. Accordingly, when the locking bars are placed in the latched position, the shaft 45 of a hockey stick that is mounted within one of the compartments can be resiliently held in place by the strips.

The portions of the dowels that protrude to either side of the vertical frame legs are covered with a rubber sleeve that provides a surface for gripping the shaft of a hockey stick, further securing the stick within a compartment and protecting the surface of the stick.

As noted above, handle 22 of the rack spans the length of the rack between the two opposed vertical legs 20—20. The handle provides a means by which the rack can be gripped and carried from place to place. As should be evident, depending on the number of sticks and their orientation within the frame, the center of gravity of the frame can change rather dramatically. A person carrying the rack by the handle can simply shift his or her hand position along the handle to a point where the load is well balanced and thus easily transported.

While the present invention has been particularly shown and described with reference to the preferred mode as illustrated in the drawing, it will be understood by one skilled in the art that various changes in detail may be effected therein without departing from the spirit and scope of the invention as defined by the claims.

I claim:

1. A rack suitable for carrying and storing a plurality of hockey sticks that includes;

an inverted U-shaped frame having two vertical legs co-joined by a horizontal cross bar, said frame having a front side and a rear side, a series of spaced apart support members extending outwardly to the front and rear sides of each vertical leg, said support member on one vertical leg being horizontally aligned with the support members on the other vertical leg, a pair of latching arms hinged to said frame on either side of each vertical leg for movement between an open position wherein sticks can be mounted upon said support members and closed position wherein said latching arms close against said support members to capture the sticks in said frame.

2. The rack of claim 1, which further includes rails attached to the front and rear sides of the two vertical legs just below the cross bar.

3. The rack of claim 2 wherein the rails and said support members extend outward from said vertical leg an equal distance.

4. The rack of claim 3 wherein said latching arms are hinged upon said rails.

5. The rack of claim 4 wherein the inside surfaces of said latching arms which face said vertical legs are provided with a resilient material.

6. The rack of claim 4 wherein said frame and said rails are fabricated of square tubing.

7. The rack of claim 6 wherein said tubing is aluminum.

* * * * *